United States Patent [19]

Schine

[11] Patent Number: 4,697,177

[45] Date of Patent: Sep. 29, 1987

[54] HIGH RESOLUTION DOT-MATRIX CHARACTER DISPLAY

[75] Inventor: Jonathan M. Schine, Los Angeles, Calif.

[73] Assignee: High Resolution Television, Inc., Los Angeles, Calif.

[21] Appl. No.: 686,220

[22] Filed: Dec. 26, 1984

[51] Int. Cl.[4] ..... G09G 1/16

[52] U.S. Cl. ..... 340/728; 340/744

[58] Field of Search ..... 340/728, 732, 744, 748, 340/750

[56] References Cited

U.S. PATENT DOCUMENTS

| | | | |
|---|---|---|---|
| 2,921,124 | 1/1960 | Graham | 340/728 |
| 3,418,518 | 12/1968 | Reese, Jr. | 340/728 |
| 3,786,478 | 1/1974 | King, Jr. | 340/728 |
| 4,400,791 | 8/1983 | Kitado | 340/728 X |
| 4,481,509 | 11/1984 | Sasaki et al. | 340/728 |
| 4,516,119 | 5/1985 | Fukuta | 340/728 X |
| 4,544,922 | 10/1985 | Watanabe et al. | 340/728 |
| 4,555,191 | 11/1985 | Gojo | 340/728 X |

*Primary Examiner*—Marshall M. Curtis

*Attorney, Agent, or Firm*—Freilich, Hornbaker, Rosen & Fernandez

[57] ABSTRACT

Resolution of a dot-matrix character display system for a CRT is enhanced by storing two bits for each dot space, thus storing qMxn bits, where M is the number of dot spaces in a row, and N is the number of rows. The clock for reading M bits of a character in a row is increased by a factor q to generate q dots per dot space, while the CRT beam is sinusoidally modulated at the clock rate. The phase and amplitude of the modulation is selected to place the q dots displayed in a dot space at maxima of the modulation within a dot space of an MxN matrix, with a vertical displacement of $\pm\frac{1}{4}$ raster scan width of the CRT.

6 Claims, 4 Drawing Figures

HIGH RESOLUTION DOT-MATRIX CHARACTER DISPLAY

BACKGROUND OF THE INVENTION

This invention relates to a display terminal for a digital data processing system, and more particularly to increased resolution of dot-matrix display of alphanumeric and other special characters on a cathode ray tube (CRT) operated in a raster scan mode, as disclosed in U.S. Pat. No. 3,345,458.

In the raster scan mode, the electron beam is swept across the screen in parallel lines until the entire surface (frame) of the screen has been swept. The beam is controlled to brighten dots at selected points that define a character in a line of data. The beam is not brightened for at least an entire raster scan to separate one line of data from another.

Typically, a frame is divided into 40, 60 or 80 columns and 24 rows. Each column provides a character space, and each row provides a line of characters. The character space defined by a column and row count is further subdivided into a matrix of dot positions, typically $8\times10$, where each of eight horizontal dot positions in each of ten scan lines may be selectively brightened to make up a character. However, in such an arrangement, the useful dot matrix within a character space is $7\times9$, leaving a clear scan line to separate lines of characters, and a clear column at the end (or beginning) of each character space to separate characters in a line.

In a television monitor used as a data display terminal, a complete raster in a frame is divided into two fields of 262.5 scan lines per field, usually without interlacing, thus effectively providing a frame of 262 lines at the rate of 60 frames per second. For data display purposes, the output of a clock generator operating in the megahertz range is divided down to obtain a 60 Hz field (V) sync rate, and down to only about 15.75 kHz to get horizontal (H) sync rates. This chain of dividers will not only synchronize the data display with the horizontal and vertical scan of noninterlaced fields, but provide the addressing information necessary to read out into a shift register trains of binary digits, where each bit 1 will cause the beam to brighten as a line is scanned. When the entire raster of lines have been scanned, the data will have been displayed, typically in 40 columns and 24 rows of characters.

For each character space of ten raster scans per line of characters, the shift register is loaded with a new train of binary digits, which define dots to be displayed, as the previous train is shifted out into a video mixer that combines sync and blanking with the binary video into a composite signal for display. In the CRT display unit, a horizontal (H) and vertical (V) drive generator responds to the horizontal and vertical sync pulses to produce the horizontal and vertical drive signals applied to deflection coils, while the video signal from the shift register and the blanking signals are applied as the composite video to the cathode of the CRT. In that way, the beam is brightened for dots defined by 1 bits out of the shift register, and blanked for 0 bits and for line and field retrace.

To form a line of characters the clock frequency divider is used to address a random access memory (RAM) for each line of 40 characters, one character at a time in sequence. Each output character code, together with the output of a counter that counts the lines of characters, addresses a character generator implemented with a read only memory (ROM) to produce in sequence the corresponding lines of binary digits that define the characters in the row addressed. A shift register receives the binary digits in parallel, and converts them into a serial train. After the procedure has been repeated ten times for one line of 40 characters, for example, the address to the RAM is advanced to the next line of 40 characters. In that manner the output of the RAM addresses the character generator to convert the character code out of the ROM into the actual rows of dots for the characters.

The number of raster scans per field is limited to 262. For a block of $40\times24$ characters, with an $8\times10$ matrix for each character, for example, there must be $10\times24=240$ raster scans used. The rest of the time (22 raster scans$\times63.5$ $\mu$sec per raster scan) is not available for data display, and is instead used for field retrace.

Each dot is in actuality an ellipse with the major axis horizontal. Consequently, adjacent horizontally spaced dots tend to run together, but not fully while adjacent vertical dots do not. Space between adjacent dots in the vertical direction are more noticeable in the character than in the horizontal direction. This deficiency in both the vertical and horizontal direction provides rather low resolution of characters displayed.

A simple way to increase vertical resolution would be to use interlaced fields so that the odd field is displaced a half raster scan space, but since the data being displayed is constant until changed, the characters will appear to flicker up and down. That is quite disturbing to the viewer. It is therefore preferable to use noninterlaced fields to display data refreshed 60 times per second. The problem is to increase vertical and horizontal resolution within those constraints.

SUMMARY OF THE INVENTION

In accordance with the present invention, resolution of dot-matrix character display is increased by vertical modulation of the horizontal raster scan at a frequency that will produce one or more complete cycles per dot space. For optimum resolution, the depth of modulation should be at about $\pm\frac{1}{4}$ the spacing of the raster scans. Then, in place of an M-bit word for each raster scan of a character, a qM-bit word is read into a parallel-to-serial converting shift register clocked at q times the frequency required for an M-bit word, where q is a whole number, so that for each dot space of an Mxn matrix there are q dots that may be displayed, each displayed at a point of maximum deflection of the vertical modulation. Not all dot positions need be used in making up a character, i.e., in producing a bit 1 by the character generator in the character bits of a qMxn matrix per character. To conserve memory space, the matrix may be reduced to $q(M-1)\times N-1$ since the first (or last) column of dot spaces in a character will always be zero to provide space between characters, and the last raster scan of a character matrix will always be a train of zeros to provide space between lines of characters. In fact, the space between characters may be increased to two, three or more dot spaces without affecting the character generation by this technique, such as for right hand justification achieved through computer controlled variable spacing between characters. In that manner a fixed qMxn dot matrix space is used for each character in a conventional Mxn space with the extra dots displaced vertically a half line space and offset horizontally a half dot space of the Mxn space. While the invention is intended primarily to increase vertical resolution, it is evident that horizontal resolution is also enhanced in that each dot is displayed at a maxima of the raster scan modulation, thus minimizing the tendency of dots to stretch out horizontally beyond their dot space due to inherent luminance bandwidth limitations of the cathode ray tube.

The novel features of the invention are set forth with particularity in the appended claims. The invention will best be understood from the following description when read in conjunction with the drawings.

DESCRIPTION OF PREFERRED EMBODIMENTS

Figure 1:
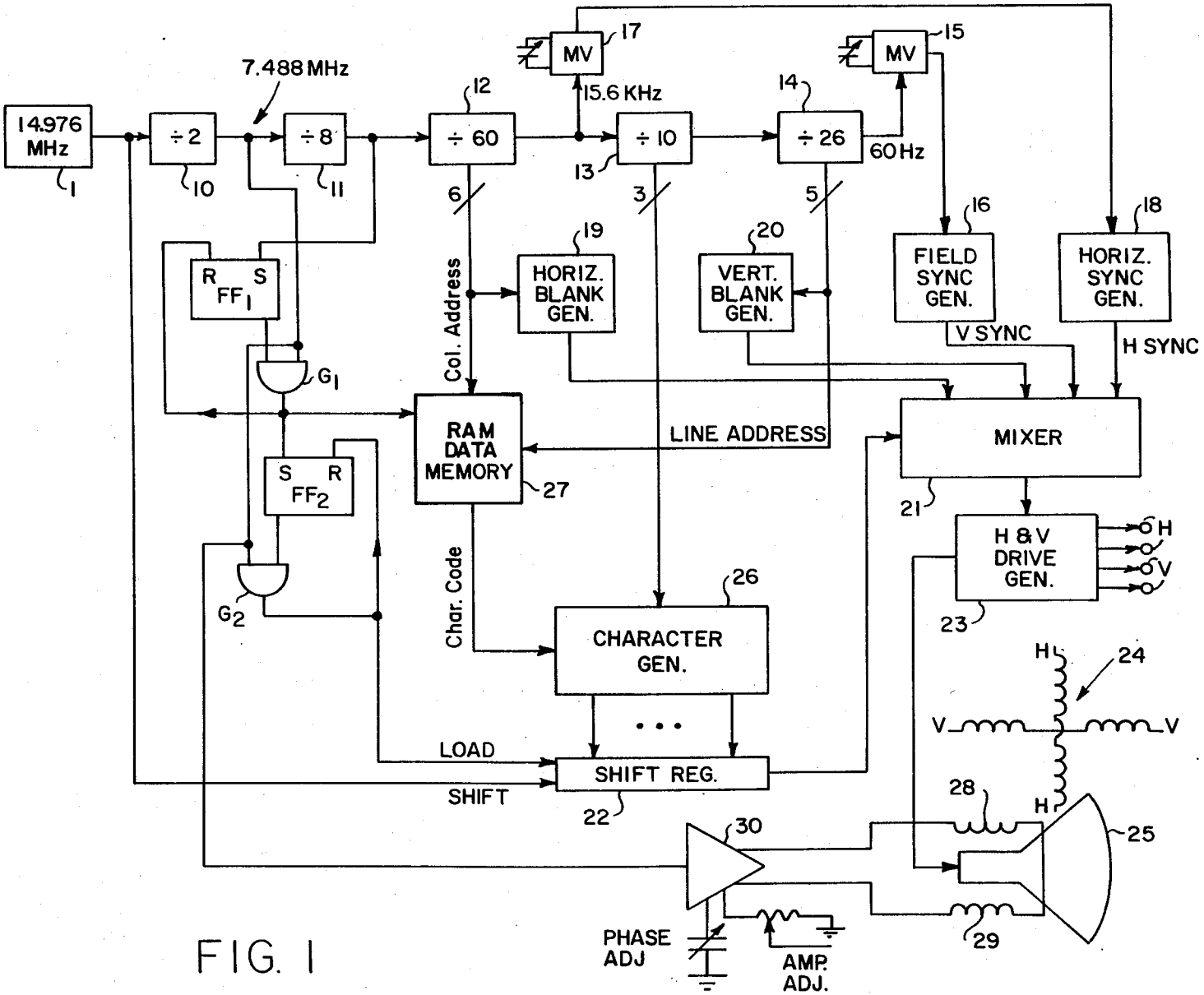
FIG. 1 is a block diagram of one embodiment of the present invention.

Referring now to FIG. 1, the portion of a data display system into which the present invention is incorporated will first be described. Then the present invention incorporated therein will be described in detail.

A clock generator 1 operating at 14.976 MHz is connected to a frequency dividing chain comprised of binary counters 10 through 14. The output of the last counter 14 at 60 Hz is connected by a delay multivibrator 15 to a vertical (V) sync generator 16 for field synchronization. The output of the counter 12 at 15.6 kHz is connected by a delay multivibrator 17 to a horizontal (H) synch generator 18 for synchronizing the display of 260 rasters per field at the rate of 60 field per second, which is the field rate of conventional interlaced television. The multivibrators are included to provide variable delay that can be used to adjust the H and V sync pulses.

The H and V sync signals are combined with raster and field blanking signals derived from blanking generators 19 and 20 which decode the outputs of counters 12 and 14 to produce horizontal and vertical blanking signals at all points outside the $40\times24$ character display, as determined by the column address from the counter 12 and the line address from the counter 14. The H and V signals are combined in a mixer 21 which adds dot display signals from a shift register 22 to produce a composite character display signal. This composite signal is applied to a conventional horizontal and vertical (H and V) drive generator 23 which drives the H and V deflection coils in a yoke 24 of a cathode ray tube 25, and passes on the dot display signals to the cathode of the display tube, as is conventional for data display terminals or television monitors.

The dot display signals from the shift register represent a continous train of dot-matrix coded binary digits in groups of 16, one group for each of 40 characters of a line of data. To produce the entire line of characters, each in an $8\times10$ dot matrix, a set of 10 trains, each of 320 bits, are read into the shift register 22 from a character generator 26, one character code group of 8 bits per character repeated ten times for each of the 40 characters in a row, or line of data.

The divider 12 is used to address a RAM data memory 27 for the 40 characters in a line. Note that there are 60 possible character addresses generated by the divider 12, but only character addresses 11 through 50 are decoded, thereby effectively providing a blank space of 10 characters on each side of the data display block which is forced to be blank by the horizontal blanking generator 19.

The RAM data memory is advanced from line to line by a line address from the divider 14. Here again there are 26 line addresses possible, but the RAM memory only accepts addresses for lines 2 through 25 thereby effectively leaving a blank line above and below the block of data which is forced to be blank by the vertical blanking generator 20.

The output of the divider 11 sets a flip-flop $FF_1$ which enables an AND gate $G_1$ to transmit the next clock pulse from the clock generator 10. That transmitted pulse not only synchronizes the operation of the RAM data memory in reading out a character code as an address for the character generator, but also resets the flip-flop $FF_1$. The output of the AND gate $G_1$ sets a flip-flop $FF_2$ to enable an AND gate $G_2$. The next clock pulse from the clock generator 10 is then passed so as to not only load the shift register 22 from the character generator output but also reset the flip-flop $FF_2$.

Each character code read out of the RAM data memory may be according to any character code for which the character generator is designed, such as ASCII. That code is used to address the character generator 26 which has stored the dot code matrix for each character. Assuming an $8\times10$ matrix, the character generator 26 addresses each of the ten consecutive rows of the 40 matrices specified in sequence by the character code from the RAM data memory 27. A line of data consists of 40 characters, that may include not only punctuation and other symbols besides alphanumeric characters, but also spaces, i.e., $8\times10$ matrices of all zeros as called for by data stored in the memory. As the RAM data memory is advanced across forty characters for ten consecutive times, the divider 14 holds the same line address, but each time the output of the divider 12 increments the divider 13, the output of the divider 13 is advanced by one to advance the character generator to the next row of dots for all matrices of the 40 characters in the line of data characters. Note that a 7-bit code is read out each time the column address is incremented by the output of the frequency divider 11.

The synchronized load may take place during the time the nonexistent eighth bit is read out of the shift register 22. If this is the last bit of the character generator code left blank for spacing from the next character generator code, the shift pulse is effectively shifting out a bit 0 at the time the next 7-bit code is loaded into the shift register. This is accomplished in the shift register which has 7 stages to store a 7-bit code, and after shifting out 7 bits, the load signal occurs, overriding the shift control, and forcing the output of the shift register to zero. That can be done by an inhibit gate on the shift input that receives the load signal at its inhibit input, and an output gate normally enabled to pass the bits shifted out except during the presence of a load signal. In that manner, the eighth bit not read from the ROM is effectively inserted as a bit 0 in the 8-bit train at the output of the shift register 22.

The foregoing arrangement is common to virtually all data display terminals that have been devised in accordance with the teachings of the aforesaid U.S. Pat. No. 3,345,458 with only minor variations in implementation, such as the size of the character dot matrix, the number of characters displayed in a line, and the total number of lines, besides details of circuit implementation. A frame of 40×24 has been chosen for the embodiment described herein for the purpose of using a conventional television monitor as a data display terminal.

The present invention departs from the foregoing by providing a qMxn dot matrix and a frequency source which increases by q the clock frequency otherwise used for display of data characters with Mxn dot matrices. In the embodiment described herein as an example, and not as a limitation, M=8, N=10, and q=2. Only the first (or last) 7 dot positions are used in each row, and only 9 rows are used in each character space. Consequently, instead of loading the shift register 22 with a dot code of M bits, i.e., 8 bits, it is loaded with a dot code of 2M bits, i.e., 16 bits. The output of the frequency generator 1 drives the shift register 22 at twice the rate that would be used for an 8 bit code, thereby providing two bits per dot space of an 8×10 dot matrix. This allows display of twice as many dots in each character, two in each dot space of an 8×10 dot space matrix.

Figure 2:
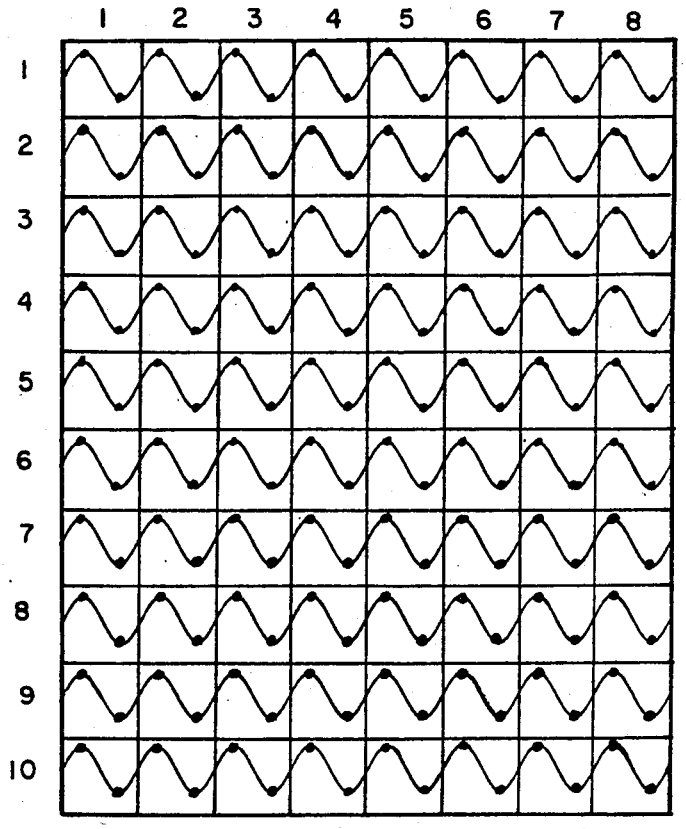
FIG. 2 illustrates the modulated raster scan of one $8\times10$ character space.

The output of the frequency divider 10 is used to drive auxiliary vertical deflection coils 28 and 29 via an amplifier 30 having phase and amplitude control so that for each character dot space of an 8×10 matrix, the CRT electron beam is modulated through one cycle, as shown in FIG. 2. The phase of modulation is adjusted relative to the two dots per dot space to place the center of the two dots at the maxima of the deflection, as shown in FIG. 2. The depth of modulation is adjusted for the desired vertical displacement of each dot, such as $\pm\frac{1}{4}$ raster scan spacing, i.e., $\pm\frac{1}{4}$ row spacing of a dot matrix. Each potential dot position is indicated in FIG. 2 by a point. In practice the points are displayed with dots having a diameter at least a quarter of a row spacing, and preferably between a half and a full dot row spacing.

By displaying the dots at the maxima of the sinusoidally modulated raster scan, the tendency for the dots to be drawn out in a horizontal direction due to bandwidth limitation of the cathode ray tube is minimized. This is so because the raster scan is curved at that point, and has a horizontal direction only instantaneously. So rather than producing dots elongated horizontally, the dots at the negative maxima are U shaped, and the dots at the positive maxima are inverted U shaped dots, with very short if any parallel portions actually appearing. This reduces the tendency of dots to run together in the horizontal direction while increasing the vertical dimension of the dots, and most important for enhanced vertical resolution, twice as many rows of dots.

It should be noted that while twice as many dots may thus be displayed for each character in the same dot matrix space, not all of the second dot positions of the matrix are used for every character, i.e., not all bit-1's of an 8×10 dot matrix code are replaced by a double bit 1 (couplet 1,1), and in some instances bit-0's of the 8×10 dot matrix code may be replaced by a 0,1 or 1,0 couplets, whichever produces the best formed character. This requires that a new dot matrix code be devised for each character and stored in the character generator expanded to store 16×10 bits per character, or in practice 14×9 because the two blank columns and the last blank row of each character can be caused to be effectively zero bits in the way the shift register is loaded and/or otherwise controlled, rather than by the bits stored in the character generator.

Figure 3A:
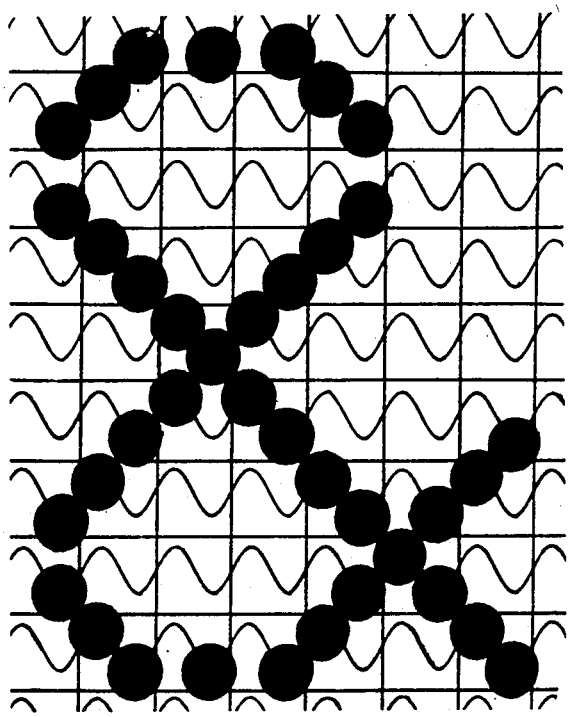
FIG. 3*a* illustrates the arrangement of dots for the ampersand character in the modulated raster scan space for one character.
Figure 3B:
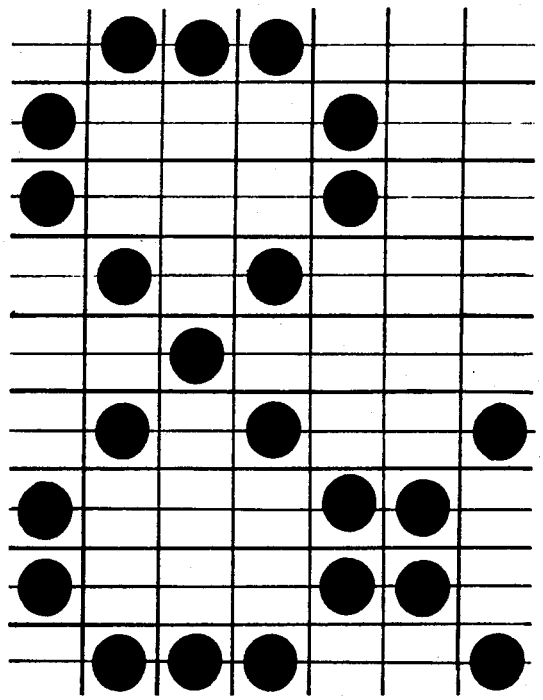
FIG. 3*b* illustrates for comparison the arrangement of dots for the same character according to the prior art.

The present invention optimizes the vertical resolution of each code by the judicious selection of bits to be stored in each row of the matrix, as shown in FIG. 3*a* for the ampersand character. The improvement in vertical resolution over the prior art may be best appreciated by comparison with FIG. 3*b* which illustrates a conventional 8×10 dot matrix for the same character. Although not shown, it should be appreciated that each dot displayed with an unmodulated raster scan is elongated, and is not a well defined circular dot because of the velocity of the electron beam along the CRT. Bandwidth limitations of the CRT display prevent turning the beam on and off fast enough to prevent this horizontal elongation along the scan line. In the present invention, the beam is being turned on and off at the positive and negative maxima of modulation where the horizontal component of beam velocity is a minimum, thus allowing the dots to be displayed more nearly as perfect as the circular dots illustrated in FIG. 3*a*.

The present invention is most effective in improving resolution where the character lines are diagonal, such as in the letter A, but it will be appreciated that even characters having only horizontal and vertical lines may be improved, such as the letter F, by simply replacing each bit 1 with a couplet (1,1) for display.

For even greater enhancement of resolution, the factor q may be increased to, for example, 4 while the modulation frequency is increased proportionally to provide four maxima in each character space, one for each of four dot positions. Again, not all positions need be used; instead a judicious choice is made from the 4Mxn matrix, where N is effectively doubled as in the case of the 2Mxn matrix.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. A method of displaying on a cathode ray tube having an intensity and raster-scan controlled beam enhanced resolution alphanumeric and other characters, including symbols of conventional and arbitrary form, in a dot-matrix of rows defined by raster scans and columns utilizing a HOM character generator comprising the steps of storing in said ROM character generator a qMxn matrix of binary 1's and 0's, said binary 1's representing dots created by intensity control of said beam making up characters to be displayed, where q is an integer greater than one for generating more than one dot for display in each dot space of an Mxn matrix, M is the number of horizontal dot spaces in each row, and n is the number of rows of dot spaces in a character matrix, and cyclically modulating in a vertical direction the cathode ray tube beam above and below the horizontal center of each row at a predetermined fixed rate for display of dots making up characters, thereby displacing said dots above and below said horizontal center of each row.

2. A method as defined in claim 1 wherein q is equal to 2 for two binary digits stored in said character generator for each of said Mxn dot spaces, and each of said two binary digits may be independently selected to be a binary 1 or 0 when storing in said ROM character generator a pattern of binary digits for each character to be displayed, and wherein said vertical modulation is at a frequency and phase to produce one whole cycle of modulation per dot space, and binary digits stored in said character generator are read at a rate of two binary digits for each cycle of said modulation per dot space for display at the positive and negative maxima of the cyclical modulation of the cathode ray tube beam.

3. A method as defined in claim 2 wherein said vertical modulation is selected to have an amplitude of about $\pm\frac{1}{4}$ the raster scan spacing of said cathode ray tube display system.

4. In a cathode ray tube display system for generating dot-matrix patterns for display of alphanumeric characters and other symbols of conventional and arbitrary form, each character pattern being displayed in a matrix consisting of Mxn dot spaces, where M is the number of horizontal dot spaces in each row, and n is the number of rows of dot spaces in a character matrix, said system having a character generator for storing binary digits defining dots in said Mxn dot spaces for each character to be displayed, wherein rows of binary digits are read for display in series as the electron beam of said cathode ray tube scans rasters in sequence, an improvement comprising means for storing q binary digits for each dot space of a character, where q is an integer greater than 1 and each of said binary digits may be selected to be a binary 1 or 0 independent of the other of the q binary digits, thereby storing qMxn binary digits for each character, means for reading out said qM binary digits in series for each raster scan display of characters, said qM binary digits being read in synchronism with the raster scan of M dot spaces for each character in sequence, thereby reading out q binary digits for each dot space, and means for modulating the vertical deflection of said cathode ray tube beam as it raster scans horizontally with a frequency of modulation selected to produce a whole number of cycles in each dot space with a phase of modulation to display said q binary digits at maxima of modulation of said cathode ray tube beam.

5. The improvement of a data display system as defined in claim 4 wherein q is selected to be 2, and the phase of modulation is selected to display said 2 binary digits at positive and negative maxima of the vertical modulation of said cathode ray tube beam.

6. The improvement of a data display system as defined in claim 5 wherein said vertical modulation is selected to have an amplitude of about $\pm\frac{1}{4}$ the raster scan spacing of said cathode ray tube data display system.

* * * * *